US006488201B1

(12) United States Patent
Van Eijndhoven et al.

(10) Patent No.: US 6,488,201 B1
(45) Date of Patent: Dec. 3, 2002

(54) METHOD FOR FORMING A CORNER JOIN AT A CORNER OF A BOX, METHOD FOR MAKING A SOLID BOARD BLANK PERMEABLE TO AIR, BOX OBTAINED USING ONE OR BOTH METHODS, ASSEMBLY OF A BOX AND FILLING, THE USE OF A BOX AND A BOX BLANK

(75) Inventors: Peter Paul Van Eijndhoven, Barneveld (NL); Richard Vos, Hoogeveen (NL); Paulus Maria Van Gurp, Bavel (NL)

(73) Assignee: Kappa Packaging Development Center B.V., Hoogeveen (NL)

( * ) Notice: Subject to any disclaimer, the term of this patent is extended or adjusted under 35 U.S.C. 154(b) by 0 days.

(21) Appl. No.: 09/673,921

(22) PCT Filed: Apr. 26, 1999

(86) PCT No.: PCT/NL99/00241

§ 371 (c)(1),
(2), (4) Date: Oct. 24, 2000

(87) PCT Pub. No.: WO99/55590

PCT Pub. Date: Nov. 4, 1999

(30) Foreign Application Priority Data

Apr. 24, 1998 (NL) ..... 1008998

(51) Int. Cl.[7] ..... B65D 5/28; B31B 3/62

(52) U.S. Cl. ..... 229/191; 229/5.84; 229/120; 229/190; 229/941; 493/63; 493/128; 493/151

(58) Field of Search ..... 229/5.81, 5.83, 229/5.84, 120, 190, 191, 207, 941; 493/63, 128, 130–132, 148, 150, 151, 363–365

(56) References Cited

U.S. PATENT DOCUMENTS

| | | | | |
|---|---|---|---|---|
| 2,533,773 A | * | 12/1950 | Foret | 229/120 |
| 3,213,890 A | * | 10/1965 | Battersby et al. | 229/5.84 |
| 3,602,422 A | | 8/1971 | Dewhurst | |
| 3,706,410 A | | 12/1972 | Baker | |
| 4,056,223 A | | 11/1977 | Williams | |
| 4,117,971 A | * | 10/1978 | Itoh | 229/941 |
| 5,024,709 A | * | 6/1991 | Faulkner, III et al. | 493/128 |
| 5,103,980 A | * | 4/1992 | Kuchenbecker | 229/120 |
| 5,711,475 A | | 1/1998 | Tedford, Jr. | |
| 5,992,735 A | * | 11/1999 | Oosterbaan | 229/191 |

FOREIGN PATENT DOCUMENTS

| | | |
|---|---|---|
| DE | 89 06 588 | 9/1989 |
| FR | 2178687 | 11/1973 |
| FR | 2639616 | 6/1990 |
| FR | 2717444 | 9/1995 |
| GB | 2300179 | 10/1996 |
| WO | WO 93/22138 | 11/1993 |

* cited by examiner

*Primary Examiner*—Gary E. Elkins
(74) *Attorney, Agent, or Firm*—Sughrue Mion, PLLC

(57) ABSTRACT

A corner join in a box is formed from a blank having a base section (2) and two side wall panels (4, 6) each joined thereto via a fold line (3, 5). A joining flap (15) is joined to one of the side wall panels (6) via a fold line (7). The fold line of the joining flap (15) essentially defines the corner, and the point of intersection of the three fold lines (3, 5, 7) is located in the base panel approximately at the corner. The side wall panels are joined to one another by placing the joining flap in contact with the second side wall panel (4) such that it overlaps the later in an overlap area, and fixing it to the side wall panel. A mastic-like filler (204; FA) is applied in or on the inside of the panel fold line (3) to which the fixing flap (15) is fixed at the location of the overlap area with the fixing flap (15). The invention further relates to a box and blank made of solid board which has been coated on one or both sides with a coating that is essentially impermeable to gas and has been provided with air passages through the coating, and to a method for making the air passages.

40 Claims, 8 Drawing Sheets

Figure 1:
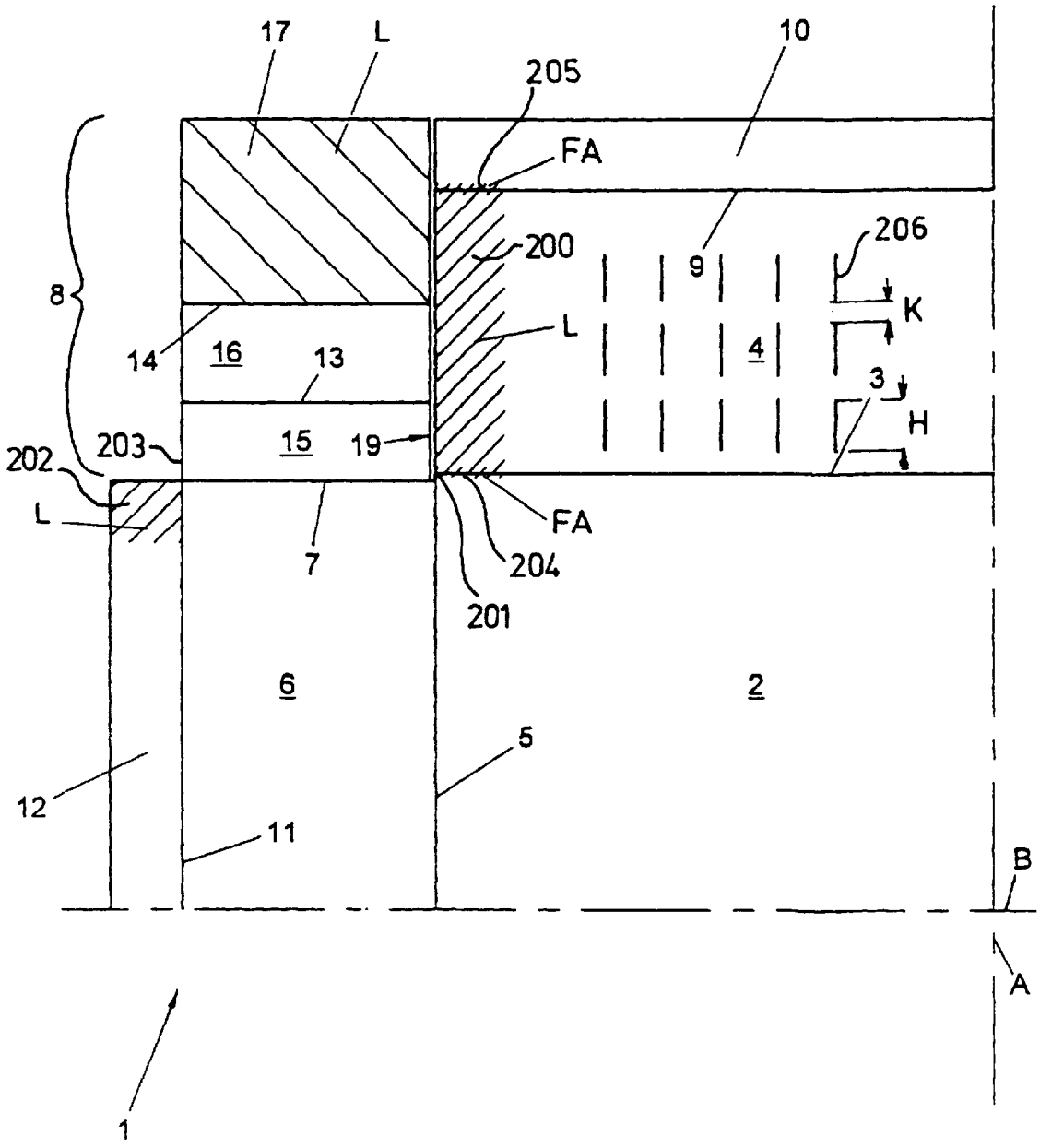

METHOD FOR FORMING A CORNER JOIN AT A CORNER OF A BOX, METHOD FOR MAKING A SOLID BOARD BLANK PERMEABLE TO AIR, BOX OBTAINED USING ONE OR BOTH METHODS, ASSEMBLY OF A BOX AND FILLING, THE USE OF A BOX AND A BOX BLANK

According to a first main aspect the invention relates to a method for forming a corner join at a comer of a box, wherein the box has been/is formed from a blank comprising a base panel, a first side wall panel joined to said base panel via a first panel fold line, a second side wall panel joined to said base panel via a second panel fold line and a joining flap joined to the first side wall panel via a joining flap fold line;

wherein the joining flap fold line essentially determines the corner when the corner join has been formed;

wherein the first and second panel fold lines and the joining flap fold line essentially intersect one another at the bottom of the comer at the base panel and the first and second side wall panels extend as far as the corner when the comer join has been formed, and wherein the first side wall panel is joined to the second side wall panel by placing the joining flap such that it overlaps the second side wall panel in an overlap area on the second side wall panel and fixing it thereto.

A method of this type is generally known. With this arrangement, both according to the prior art and also according to the invention still to be described below, the joining flap can either be placed with its inside against the outside of the second side wall panel and fixed thereto, for example by gluing or stapling, or placed with its outside against the inside of the second side wall panel and fixed thereto, for example by gluing or stapling. Placing the joining flap with the outside against the inside of the second side wall panel is preferred since the box to be obtained is then as flat as possible on the outside, which is practical for further manipulation and further handling of the box.

One problem with corner joins formed in this way is that the box is not completely gas- and liquid-tight at the corner. In general, a free flow channel from the interior of the box to the exterior of the box and vice versa remains through the corner point of the corner join located at a base panel. This is, in particular, a significant disadvantage when forming boxes which have to have a controllable interior atmosphere since the more or less free, uncontrolled communication between the interior and the exterior of the box disturbs the control of the atmosphere in the interior of the box and makes this appreciably more difficult and frequently even impossible.

According to the first main aspect, the invention relates in particular to a method of the type mentioned at the start, wherein, in addition, a mastic-like filler is applied, preferably in the form of a bead, in or on the inside of the second panel fold line, at the location of the overlap area.

Such a method is disclosed in FR 2 178 687, which corresponds to NL-A 73.03732. NL-A 73.03732 discloses, in FIGS. 4 and 5 and the associated part of the description, a method corresponding to the pre-characterising clause of Claim 1. According to NL-A 73.03732 a filling consisting of a tacky mixture is injected into each of the overlap join locations after the box has been fully folded and after the side wall panels have been fixed to one another by means of the joining flap, in order to make the box light-tight in the corners. This method has a number of disadvantages. As a result of injecting the filling consisting of a tacky mixture only after setting up the box and fixing the side wall panels to one another an additional subsequent operation is required which prolongs the time needed for production of one box and thus makes the production speed slower. A further disadvantage is that although a light-tight corner join can allegedly be achieved by the method according to NL-A 73.03732, it is not possible to produce a reliable light-tight corner join by this method.

The aim of the present invention is to provide an improved method for forming a corner join at a corner of a box, in particular a box for use under so-called controlled atmospheric conditions, which method results in an essentially gas- and/or liquid-tight corner join.

The abovementioned aim is achieved according to the invention in that the mastic-like filler is applied to the blank before the joining flap is placed against the second side wall panel and fixed thereto. Said mastic-like filler can be applied to the flat blank before folding the box, but it is also entirely conceivable that the mastic-like filler is applied after partially folding the box from the blank prior to fixing the joining flap to the second side wall panel. Especially in the case where the joining flap is placed with its outside against the inside of the second side wall panel and is fixed thereto, it is also conceivable that the mastic-like filler is initially applied to the underside of the joining flap and that the mastic-like filler is automatically transferred into or onto the inside of the second panel fold line at the location of the overlap area on placing the joining flap against the second side wall panel and pressing onto the latter for fixing, for example in that the mastic-like filler has been applied to the downward-facing bottom edge of the joining flap or in that the mastic-like filler has been applied in excess to the bottom of the outside of the joining flap and on pressing the joining flap against the inside of the second side wall panel is expressed between the two and transferred into or onto the inside of the second panel fold line. The essential feature is that the mastic-like filler, which, as can be seen from the above, can thus also be the adhesive for joining the joining flap to the second side wall panel, forms a sealing plug or seal, which, in particular, ensures that the join is sealed from the outside via the socalled corner point, that essentially is located on or close to the point of intersection of the first panel fold line, the second panel fold line and the joining flap fold line, towards the interior of the box and vice versa, by the mastic-like filler, which if appropriate can also be an optionally setting adhesive. Because the mastic-like filler is applied to a suitable position on the blank even before the joining flap is placed against the second side wall panel and is fixed thereto, this operation can be carried out simultaneously with another operation for forming the box, in particular if the formation of a box from a blank is automated. The mastic-like filler can be applied simultaneously with the application of further adhesive tracks or adhesive strips or simultaneously with certain folding operations. A further advantage of the application of the mastic-like filler prior to fixing the joining flap to the second side wall panel is that the air seal, or at least the reliable and simple production thereof, can be improved in this way. Specifically, the mastic-like filler will then be expressed on producing the corner join, that is to say joining the joining flap and the second side wall panel to one another, and will thus be distributed over a larger area and improve the liquid and gas seal. Said expression takes place in particular if the bottom edge of the joining flap which faces the base panel is in contact with or close to the base panel when the box is in the assembled state.

According to an advantageous embodiment of the invention, the blank is based on board or paper. However, the essence of the invention can also very readily be applied when forming corner joins in a box which is formed from a blank of a completely different type of material, such as, for example, plastic or metal.

In order to obtain a good and reliable seal it is particularly advantageous according to the invention if the filler is at least applied in or on that end of the second panel fold line which faces towards the corner.

It is particularly advantageous according to the invention if the mastic-like filler is applied to the blank before the first side wall panel is raised with respect to the base panel by folding about the first panel fold line. This is because the blank is then relatively most easily accessible for administration means for applying the mastic-like filler. Especially in the case where, in the raised position, the joining flap is located on the inside of the box and extends as far as or very close to the base panel and the filler has been applied in or to that end of the second panel fold line that faces towards the corner and/or to the bottom edge of the joining flap which, in the raised position, faces the base panel, a good gas- and liquid-tight corner join can then be achieved by pressing the bottom edge of the joining flap into the mastic-like filler when raising the first side wall panel and thus laterally forcing out excess filler.

Since the second panel fold line can form a channel to the corner, it is furthermore advantageous according to the invention if the filler is applied as a bead, which in particular extends in or on the inside of the second panel fold line. In this way it can be substantially ensured that the seal of, ultimately, the corner is further ensured by substantially reliable sealing of the channel towards that point. In this context it is particularly advantageous if the bead extends, preferably uninterrupted, along essentially the entire overlap area. If the joining flap extends as far as the base panel or to very close to the base panel, a good seal/closure between the underside of the joining flap and the base panel can in particular also be ensured in this way. In this case it is not absolutely essential under all circumstances for the mastic-like filler also to be applied directly in or to that end of the second panel fold line that faces towards the corner, although this is still advantageous.

In order further to ensure a tightly sealed, in particular gas- and liquid-tight sealed corner join, especially with regard to the reliability of the seal, it is advantageous according to the invention if the outside of the joining flap is provided with at least one adhesive strip which extends uninterrupted from the bottom edge of the joining flap, which faces towards the base panel, to the top edge of the joining flap, which faces away from the base panel, and if the adhesive strip is applied such that, when the corner join has been formed, it abuts the filler at the bottom edge of the joining flap, said filler preferably extending uninterrupted from said location of abutment to into the corner, at least when the corner join has been formed. This prevents a connecting channel, running towards a corner point, for gas/liquid communication between the interior and the exterior of the box from being able to form between the joining flap and the second side wall panel. The reason for this lies in particular in the fact that the mastic-like filler is also expressed when producing the corner join, which reliably ensures the abutment of the filler and the adhesive strip.

The production or leaving behind of such a connecting or communication channel between the joining flap and the second side wall panel can be further prevented/counteracted independently of the solution outlined in the previous paragraph, or as a supplement thereto, if the inside of the second side wall panel is provided with at least one adhesive strip which extends uninterrupted from the filler to at least the top end of the overlap area, and preferably beyond this, and abuts the filler. The uninterrupted adhesive strip extending over the height (viewed relative to the base panel) of the overlap area can thus be/have been provided both at the location of the overlap area on the second side wall panel and on the joining flap or even on both. The reason for this lies in particular in the fact that the mastic-like filler is also expressed on producing the corner join, which reliably ensures the abutment of the filler on the adhesive strip.

If the second side wall panel has been provided with a second top flap which has been formed in one piece therewith and which is joined to the second side wall panel via a second top flap fold line, which runs parallel to the second panel fold line, and has been or is folded so that it points towards the inside of the box, it is then also highly advantageous according to the invention if a mastic-like filler is applied, preferably in the form of a bead, in or on the inside of the second top flap fold line, at the location of the overlap area. In a manner comparable to that in the case of the underside of the corner join, this prevents/counteracts a communication channel to the top corner point located at the top of the corner join from being able to form at the top of the corner join.

In this context the top corner point is in particular understood to be the region in the vicinity of the point of intersection of the joining flap fold line and the second top flap fold line.

In order to prevent/counteract the formation of a communication channel, or the risk of the formation thereof, between the joining flap and the second side wall panel through to the top corner point in the case of a second side wall panel having a top flap, it is furthermore advantageous according to the invention if the mastic-like filler has been applied in or on the second top flap fold line in such a way that, when the corner join has been formed, it abuts the top end of the adhesive strip, at least assuming that the adhesive strip has been applied to the joining flap and/or that the mastic-like filler in or on the second top flap fold line abuts the top end of the adhesive strip, at least assuming that the adhesive strip has been applied or has been co-applied to the second side wall panel.

If the first side wall panel has been provided with a first top flap which has been formed in one piece therewith and which is joined via a first top flap fold line, which runs parallel to the first panel fold line, to the first side wall panel and has been or is folded so that it points to the inside of the box so as partially to overlap the second top flap at the corner in an overlap zone, it is advantageous according to the invention, in order to improve the reliability of the gas-liquid-tight seal of the corner join, if a mastic-like filler is applied, preferably in bead form, in or on the inside of the first top flap fold line at the location of the overlap zone (between the first and second top flap). With such an embodiment the seal can also be improved instead of or in addition to this if the overlap zone is provided with at least one adhesive strip, either applied to the inside of the first top flap or applied to the outside of the second top flap, which adhesive strip extends uninterrupted over the entire overlap zone in a direction essentially parallel to that of the second top flap fold line.

With the method according to the invention the mastic-like filler used can advantageously be an adhesive, in particular an adhesive such as is customary for gluing blank sections of a blank when forming boxes. The adhesive will preferably be the same as that used for gluing the joining flap to the second side wall panel.

In order further to improve, or to be able further to improve, the gas- and/or liquid-tightness of the corner join with the method according to the invention it is advantageous according to the invention if the first panel fold line and/or the second panel fold line and/or the first top flap fold line and/or the second top flap fold line are crease lines, the groove of which, that is to say the depression, is located on the inside of the fold line concerned. This has the advantage that when folding about the respective fold line there is no bulging towards the interior of the box, which bulging would make it more difficult to produce a gas- and/or liquid-tight closure/seal at the corner join to be formed. In the case of the second panel fold line and the second top flap fold line such bulging would be able to impede flat contact of the joining flap with the second side wall panel, or could make this more difficult, which, as will be clear, increases the risk of the formation of a communication or connecting channel through to the bottom or top corner point between the second side wall panel and the joining flap. On corresponding grounds it is advantageous, at least in the case where the joining flap comes to lie inside the box, if the joining flap fold line is a crease line, the groove of which is located on the outside of the joining flap fold line, since this results in a clean outside fold curve which ensures that the joining flap fits well on the remainder of the blank when the box has been formed.

In order to be able to guarantee the seal between, on the one hand, the joining flap and the second side wall panel and, on the other hand, at least if present, between the second top flap and the first top flap with virtually 100% certainty and, at the same time, also to be able to ensure a robust join between the abovementioned parts, it is advantageous according to the invention if adhesive is spread over the entire overlap area and/or the overlap zone. Both in the case of the overlap area and in the case of the overlap zone, adhesive can be spread either on one side or on both sides with this procedure. In this context, spreading on one side is understood to mean that adhesive is spread on only one of the contact surfaces and spreading on both sides is understood to mean that adhesive is spread on both contact surfaces. In relation to spreading with adhesive it must also be pointed out that the adhesive coating concerned can be either a thin or a thick adhesive coating, depending on what the requirements will be under the circumstances.

So as to be able further to improve the gas- and/or liquid-tightness of the corner join, or at least to be able to improve the reliability thereof, it is advantageous according to the invention if the joining flap has been/is constructed such that when the corner join has been formed the bottom edge of the joining flap is in contact with or virtually in contact with the base panel. Correspondingly, in the case of a second top flap it is advantageous if the joining flap has been/is constructed such that when the corner join has been formed the top edge of said flap is in contact with or virtually in contact with the underside of the second top flap.

According to a second main aspect of the invention, which advantageously can also be used in combination with the first main aspect of the invention which has been discussed above, (i.e. the gas- and/or liquid-tight corner join of a box and the method for obtaining such a corner join), the invention relates to a method for obtaining boxes which breathe in a controllable manner, wherein the blank, from which the box is/has been made up, has been produced from solid cardboard, preferably solid board, with a core of, for example, grey board, and has been coated on one or both sides with a coating, for example of plastic, such as PE, which is impermeable to gas, especially air, characterised in that the coating has been/is provided with air passages which open into the part of the core located behind the respective air passages. Here the controlled or at least controllable breathing is obtained by providing the coating with air passages which open into the part of the core located behind the coating, in particular behind the passages made therein. With this arrangement the coating can be a layer stuck on in film form or a layer applied in some other way, for example by impregnation, such as, for example, a layer of plastic or of protein. For example, it is highly conceivable that a coating has been or is provided with micropores. In this way the permeability of the coating is adjustable by means of the selection of the micropores. The core is made of a material that is permeable to gas, especially air. In this way the coating is able to allow gas, especially air, to pass through via the air passages and the core is able to allow gas, especially air, to pass through via a diffusion process. A major advantage here is that there is no direct communication between the interior and the exterior of the box, so that a bellows-like pumping action, which would result in forced transport of gas, is not produced as a consequence of shocks and movement of the panels.

According to an advantageous embodiment, with this arrangement the air passages have been/are made in one or more side wall panels, preferably outside the overlap areas. In this way it is possible to prevent the permeability of the box as a whole, which, specifically with regard to the control of the atmosphere to specific desired conditions, must as far as possible be reliably adjustable, from being influenced by the load in the box, that is to say the filling placed therein, which filling will completely or partially cover the base and could thus influence the permeability of the base.

Advantageously the air passages will be scores in the blank extending through the coating as far as the core or will be obtained by making such scores. A major advantage of such a method is that it is then possible to work with a single type of coating, which in principle is impermeable to gas, the permeability via the box walls then being adjustable depending on the product to be packed in the box by making a larger or smaller number of scores, or at least scores having a larger or smaller effective surface area/effective length.

The length of the scores, viewed parallel to the blank surface, will in general be approximately 10 mm to approximately 50 mm.

So as to affect the vertical loading capacity of the box as little as possible by the scores, it is advantageous according to the invention if the scores extend transversely to the respective panel fold line. This means that when the box has been made up and scores have been made in the side wall or side walls thereof the scores will extend vertically.

In the case of a blank covered with coating on both sides it is advantageous according to the invention if the air passages on one side of the blank have been/are made offset somewhat with respect to the air passages on the other side of the blank. In the case of air passages in the form of scores, this means that the scores on one side have been offset somewhat transversely to their longitudinal direction with respect to the scores on the other side, the scores on either side then running parallel to one another. By adjusting said offset depending on the properties of the materials used in the blank, in particular the properties of the core and the product to be packed in the box, it is possible to meet the desired permeability requirements, which are dependent on the circumstances.

In order to prevent the core from disintegrating between the scores, in particular by a sort of delamination in the plane of the blank, it is advantageous according to the invention if the offset is at least 5 to 10 mm. So that transport is possible between adjoining scores made from either side, according to the invention the offset will in general be at most approximately 30 to 40 mm. With larger offsets, in particular offsets greater than 70 mm, the transport capacity by means of diffusion through the core material will decrease appreciably in view of the relatively large offset; the various aspects will be partly dependent on the material properties, such as the permeability of the core material.

Advantageously, the air passages per coating will have been made in accordance with one or more groups of matrix patterns. In the case of air passages being made on both sides, said matrix patterns will then have been made offset somewhat with respect to one another on either side.

According to the first main aspect of the invention, the invention furthermore also relates to a box provided with one or more corner joins obtained by the method according to the invention.

According to the first main aspect the invention furthermore also relates to a rectangular box having a rectangular base panel, having two transverse walls or longitudinal walls, each forming a first side panel, and having two longitudinal walls or, respectively, transverse walls, each forming a second side panel, wherein the box has been provided with four corner joins, each obtained by the method according to the invention.

According to the second main aspect of the invention, the invention also relates to a box obtained from a blank according to or obtained in accordance with one of Claims 20–28, wherein the box has an access opening, wherein the blank has been made up of blank sections joined via fold lines into one piece, wherein the joins of the blank sections to one another are essentially gas-tight and wherein the surface spanned by the blank is essentially closed. With this arrangement the blank sections can thus have been fixed to one another essentially gas-tight and preferably also essentially liquid-tight, in accordance with various methods, such that no or at least virtually no gas and/or liquid transport between the interior and the exterior of the box is possible via the fixings. With this arrangement the surface spanned by the blank will furthermore be essentially closed, that is to say no free, essentially unimpeded passages between the one side and the other side of one wall section, base section or lid of the box will be possible. The permeability of the box is then adjusted/obtained in a controlled manner by providing air passages in accordance with one or more of Claims 20–28.

Furthermore, in accordance with both the first main aspect and the second main aspect the invention relates to an assembly of a box according to the invention and a filling placed in the box, wherein the filling comprises a living product and/or vegetables and/or fish and/or meat and wherein the access opening to the box is closed in an essentially gas-tight manner or, if appropriate, in a manner such that controlled gas permeability via the closure of the access opening is possible. With this arrangement the access opening can be closed off using a transparent film, which can be fixed to the box around the edges of the access opening by means of adhesive or some other means. The film could, for example, be of gas-permeable construction, for example permeable via a diffusion process.

Both in accordance with the first main aspect and in accordance with the second main aspect, the invention also relates to the use of a box according to the invention for packing and/or storing and/or transporting living products and/or vegetables and/or fruit and/or meat and/or fish.

Likewise in accordance both with the first main aspect and with the second main aspect of the invention, the invention furthermore also relates to a box blank which in particular is suitable for use of the method according to both the first main aspect and the second main aspect of the invention, which box blank is provided with an essentially rectangular base panel, wherein a transverse end wall panel is joined via a first panel fold line to the base panel along each of two opposite first sides, wherein a longitudinal wall panel is joined via a second panel fold line to the base panel along each of the two other sides, which transverse wall panels and longitudinal wall panels form the wall panels when the box has been made up, wherein the transverse wall panels are joined to joining flaps via joining flap fold lines on opposite side edges, which joining flaps extend in the extension of the transverse and longitudinal wall panels when the blank is flat, wherein the joining flaps are in contact with the adjoining longitudinal wall panel in an overlap area in each case, when the box has been made up, characterised in that such an adhesive pattern of adhesive has been applied to each joining flap and/or to each overlap area; and/or a mastic-like filler, such as adhesive/said adhesive, has been so applied in the region of each overlap area in or on each adjacent second panel fold line that, in a box folded and made up from the blank, wherein each joining flap has been/is glued to an adjoining longitudinal wall panel, at least the corner point located at the point of intersection of the first panel fold line, the second panel fold line and the joining flap fold line is closed off towards the interior of the box by the adhesive in the adhesive pattern and/or the mastic-like filler.

With a box blank of this type the adhesive pattern and/or the filler, such as is required for, in particular, the first main aspect of the invention, can have already been applied beforehand to the blank such that each seam extending from said point of intersection has been closed off by the adhesive or, respectively, the filler.

With this arrangement the box blank can have been formed from solid cardboard, preferably solid board of the sandwich type, but the box blank can also have been formed from corrugated board.

In particular in connection with the second main aspect of the invention, the box blank will advantageously have been provided on at least one side, preferably on both sides, with a coating, in particular a layer produced from a gas- and/or liquid-tight material, in particular a plastic or a protein.

According to a further embodiment, in particular with regard to the second main aspect of the invention, the box blank has been advantageously provided on at least one side, preferably on both sides, with a coating, in particular a layer, produced from a gas- and liquid-tight material, in particular a plastic, wherein the coating has been provided with air passages in accordance with the invention (in particular one or more of Claims 20–28).

According to a third main aspect, derived from the second main aspect, the invention also relates to a method for packing living products. Such a method is disclosed in International Patent Publication WO 93/22138. Said third main aspect of the invention can very well be used in combination with the first main aspect and/or the second main aspect of the invention.

With said known method a box is folded from a flat blank made of corrugated board, which box has been provided with essentially gas- and liquid-tight walls and is closeable at the top with the aid of flaps which are closeable over the removal opening, or by means of a plate-shaped lid that can be fixed over the removal opening. The box is therefore gas- and liquid-tight. During use, living products, such as vegetables or fruit, are enclosed in the box and a gas or gas mixture that is essentially inert, such as a gas mixture containing a high concentration of nitrogen, is then introduced into the box. By this means gas exchange in the box as a result of the residual metabolism of the living products is essentially prevented, as a result of which the period for which the products can be packed in the box is extended. The walls of said known box have been provided with at least one layer of polyethene, such that a particular specific gas permeability is obtained, said permeability being chosen depending on the products to be packed and on the storage conditions. The polyethene layer is completely moisture-tight, so as to prevent the board from losing its strength and thus to prevent the box from losing its bearing capacity.

Said known method has the disadvantage that a gas or gas mixture having a particular specific composition has to be introduced into the box, which is technically complex, time-consuming and expensive and, moreover, can easily lead to mistakes. Moreover, such a gas mixture can adversely affect the moisture balance in such a packaging. A further disadvantage of said known method is that the box has to have a particular specific gas permeability, which, moreover, is highly dependent on the storage and use conditions. After all, if the living products are stored in the box at relatively high temperatures, the gas permeability can be higher, as a result of which the storage conditions in the box can become less good. Furthermore, said specific requisite gas permeability has the disadvantage that the box is suitable for only one application, as a result of which a large number of different boxes will be needed to be able to transport a wide variety of types of products to a wide variety of destinations.

According to a third main aspect, the aim of the invention is a method of the type described three paragraphs ago, with which the said disadvantages have been avoided, whilst retaining the advantages thereof. To this end a method according to the invention is characterised in that the products are placed in a box, such as a cardboard box, having gas- and liquid-tight walls, after which an access opening in the box is closed off by means of a closure, such as a film, preferably a transparent film, which box, when closed, is essentially gas- and liquid-tight except for micro-openings in at least a number of wall panels of the box, which micro-openings have been provided to allow permeation of gas and/or liquid through the wall panel or each wall panel concerned, wherein the micro-openings together have a surface area of less than 0.1%, more particularly less than 0.05%, of the total outer surface area of the box. With this arrangement an atmosphere in the box having at least a raised $CO_2$ content can be produced and maintained by the residual metabolism of the living products packed in the box.

In contrast to the known method, with a method according to the invention a natural balance between the gases exists in the interior of the box, which balance is obtained as a consequence of the limited natural metabolism of the packed products. As a consequence of, inter alia, said natural metabolism, the relative atmospheric humidity inside the box will be able to increase to virtually 100% or, optionally, a lower desired value.

Loss of moisture from the packed products is suitably prevented from occurring by adjusting the atmospheric humidity inside the box to a relatively high level. This offers the advantage that less or even no excess weight has to be packed when filling the boxes since the packed products will at least virtually retain their initial weight during storage and transport. As a result, on balance, more economic use is made of the available volume, as a result of which storage and transport costs are even further reduced. Moreover, the quality of the packed product is better retained by this means.

Within the framework of all main aspects of the invention, living products must be understood to be all those natural products which in the packed state at least partially display a natural metabolism, by means of which exchange of at least oxygen with the environment takes place.

Under the influence of the said natural metabolism, the concentration of oxygen ($O_2$) in the box falls and, at the same time, the concentration of carbon dioxide ($CO_2$) in the box rises. By this means an atmosphere is created in which the products acquire a relatively long shelf life. The natural metabolism of the living products is suppressed. Moreover, the concentration of carbon dioxide in the box is prevented from becoming unacceptably high by the residual leakage that takes place.

In an advantageous embodiment a method according to the third aspect of the invention is characterised in that a box is used in which the micro-openings have a maximum width of less than 20 micrometers, more particularly an average width of between 10 and 20 micrometers.

Micro-openings of such a small width or cross-section have the advantage that moisture is not able to pass through said micro-openings unimpeded. Moisture will pass through the micro-openings only by, for example, capillary action or by suction action of the board located in or behind the micro-openings, as a result of which limited moisture transport through the wall of the box is possible. Moreover, the fact that gas transport, or at least gas migration through the wall of the box is possible through said micro-openings is of more importance for influencing the atmosphere in the box, in particular the $O_2/CO_2$ ratio. Such micro-openings are also the subject of the second main aspect of this invention.

Closing off the open side or access opening of the box with the aid of a, preferably flexible, film offers the advantage that said film is simple to fix on longitudinal edges of the box, whilst it takes up little space. By making the film transparent, the contents of the box can be inspected without the gas-tightness thereof having to be broken.

Making the micro-openings in the wall sections of the box offers the abovementioned advantages. Making said micro-openings by perforating the at least one coating with the aid of board fibers offers the advantage that no further steps for processing the board are required. The at least one coating needs to be applied only to one surface of the board of a suitable roughness, such that fibers will protrude through the coating. With this arrangement said fibers have the advantage that they will ensure capillary action.

Surprisingly, it has been found that micro-openings having a total surface area of, for example, 0.1% or less of the total outer surface area of the box lead at least to a particularly good gas and moisture balance inside the box, virtually unaffected by the ambient temperature. In this context micro-openings must be understood as also comprising damage to the coating, for example in the case of punch and fold lines.

In a further preferred embodiment a box according to the invention is characterised in that support columns have been formed in the corners of the box, preferably from the joining flaps by means of folding.

The support columns in the corners of the box offer the advantage that the box has high strength in the vertical direction, so that good stacking of filled boxes is possible. Folding of such support columns from the joining flaps offers the advantage that there are fewer seams, whilst, moreover, the complete box can then be folded from a single blank. The support columns offer the advantage that adequate bearing capacity is maintained even if the board becomes somewhat damp, whilst the boxes can nevertheless be placed close against one another by the side wall panels and/or end wall panels.

Figure 2A:
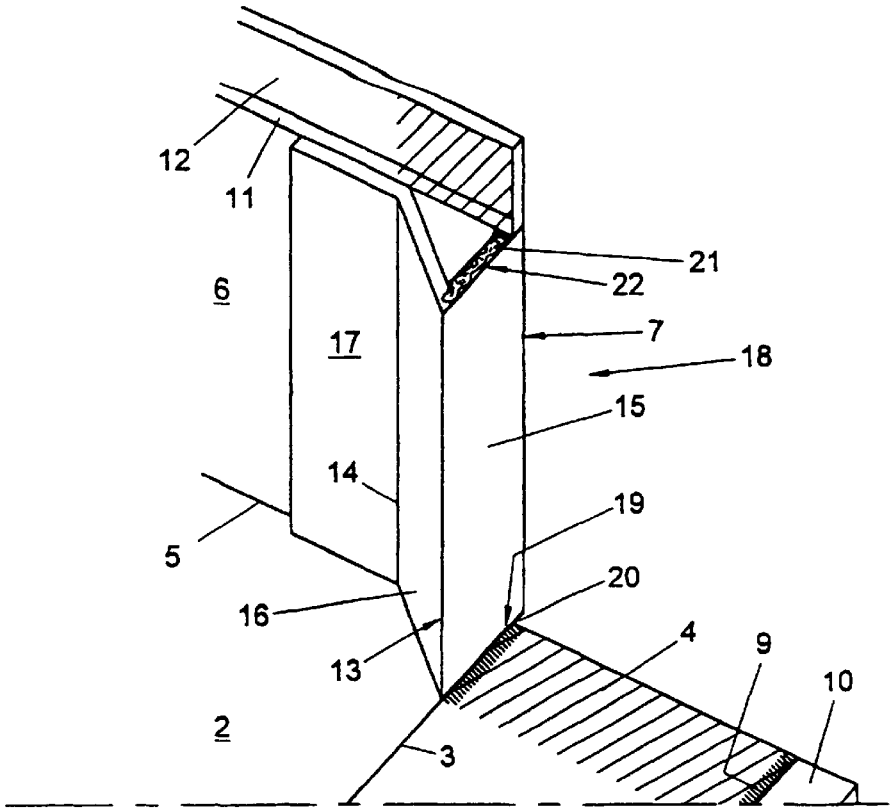
Figure 2B:
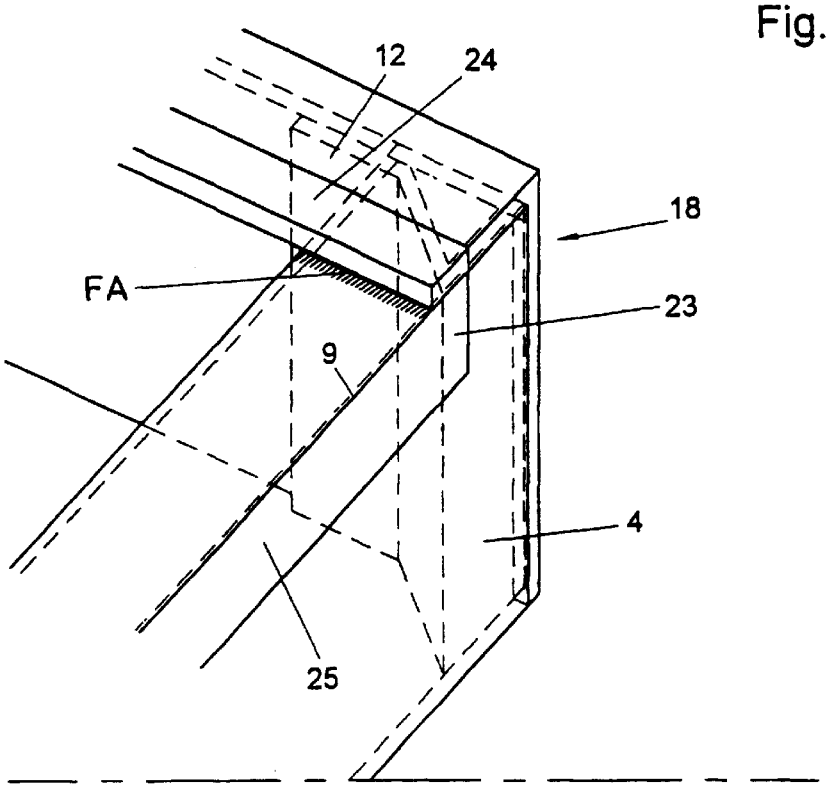
Figure 3:
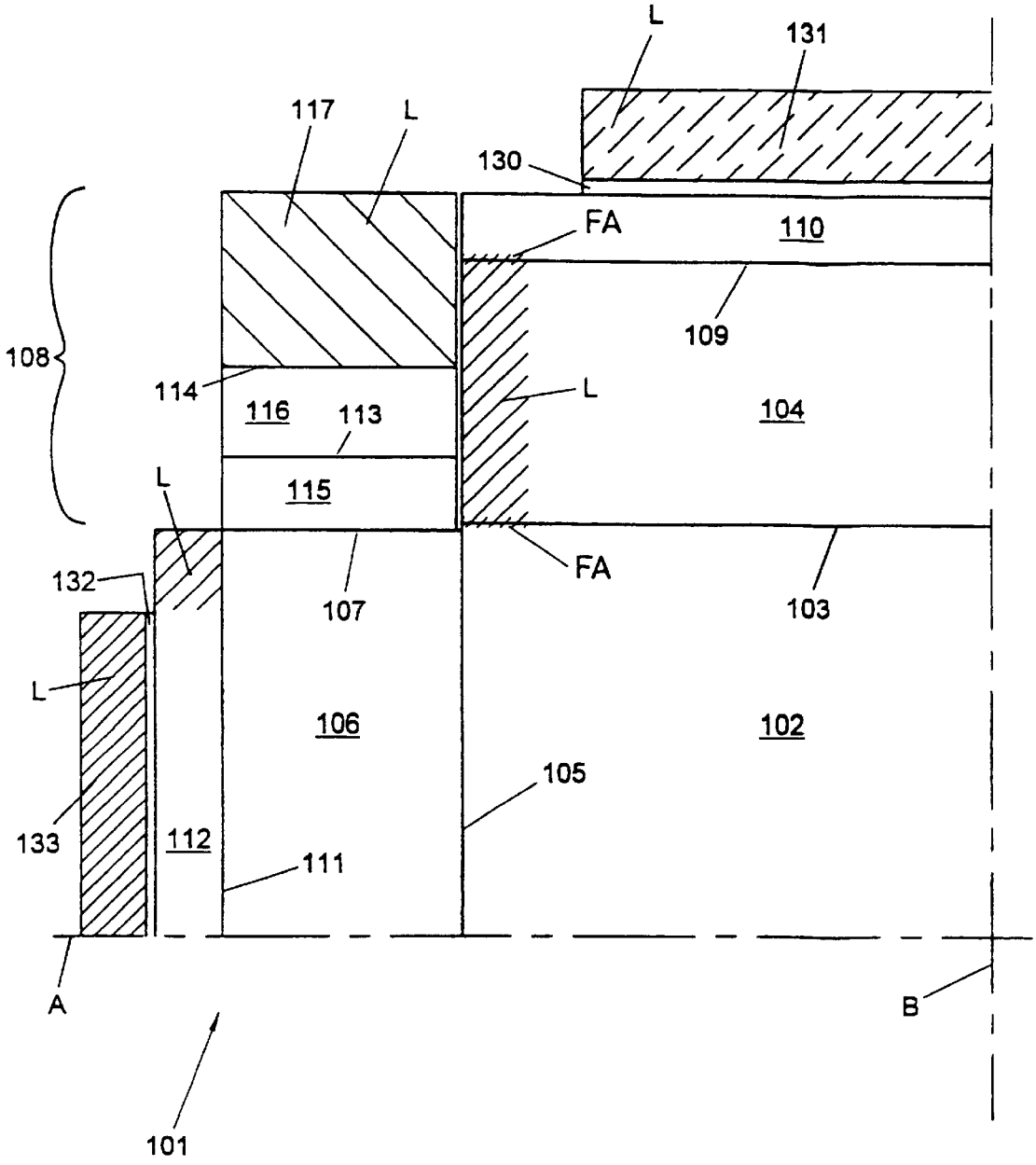
Figure 4A:
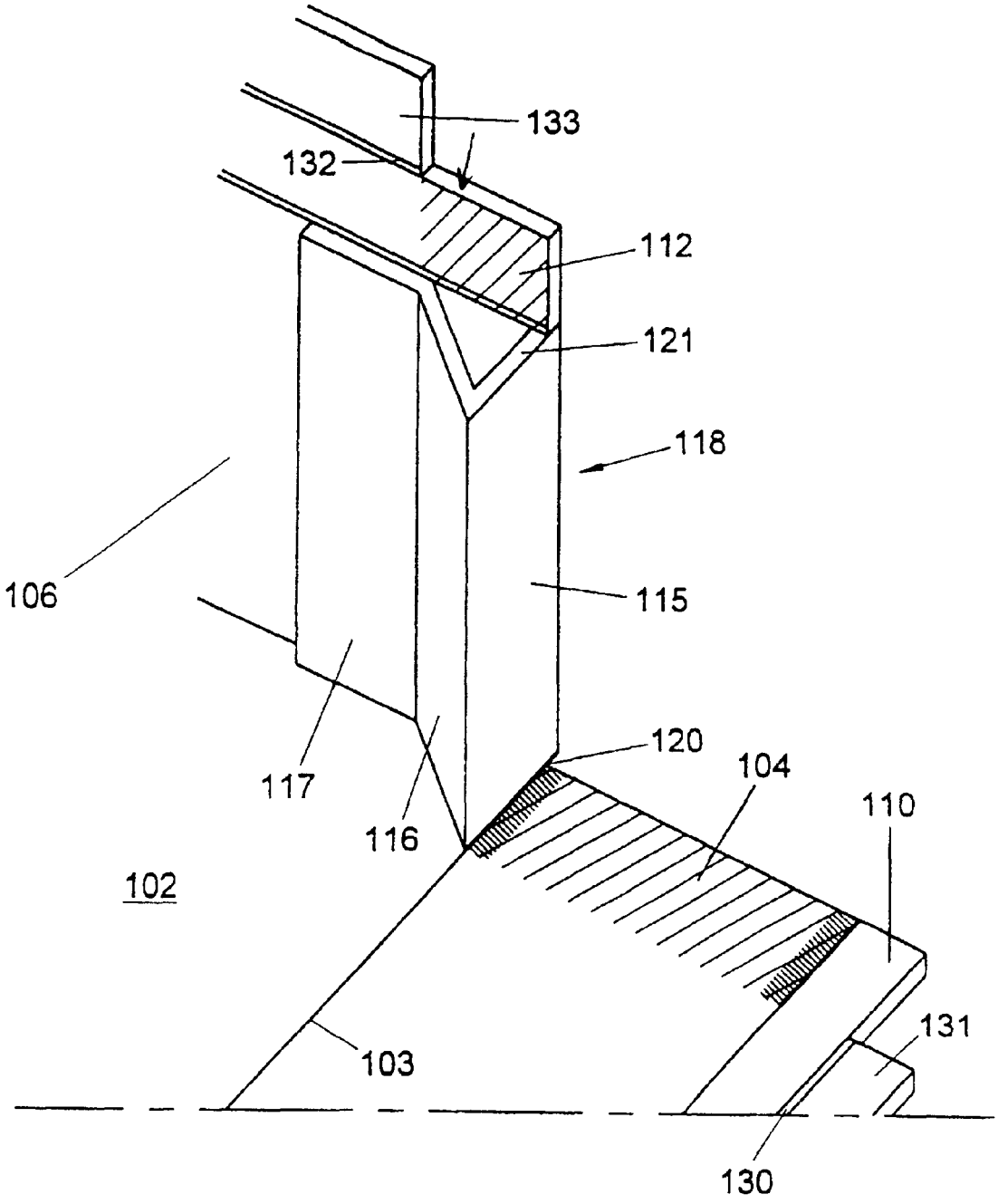
Figure 4B:
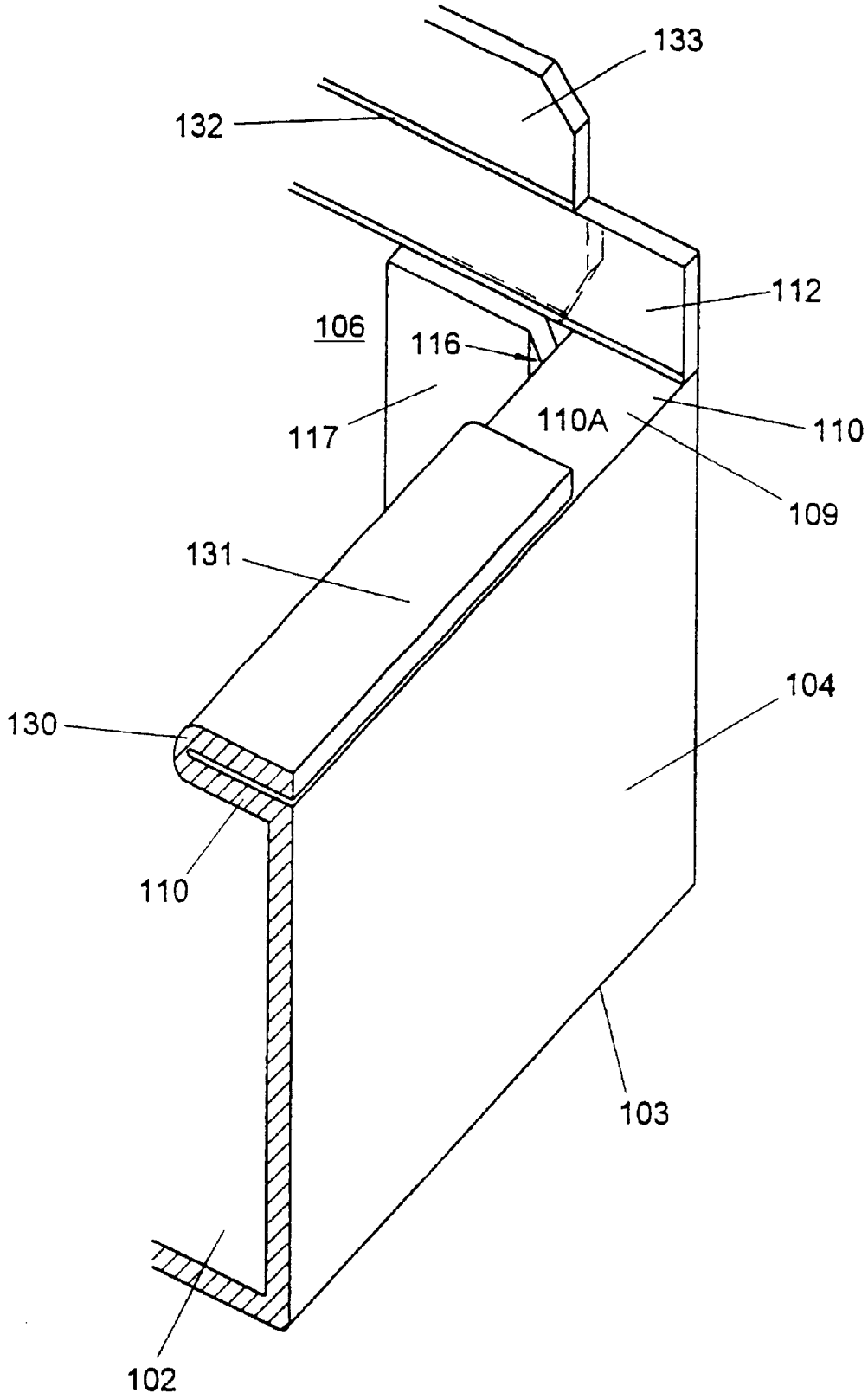
Figure 4C:
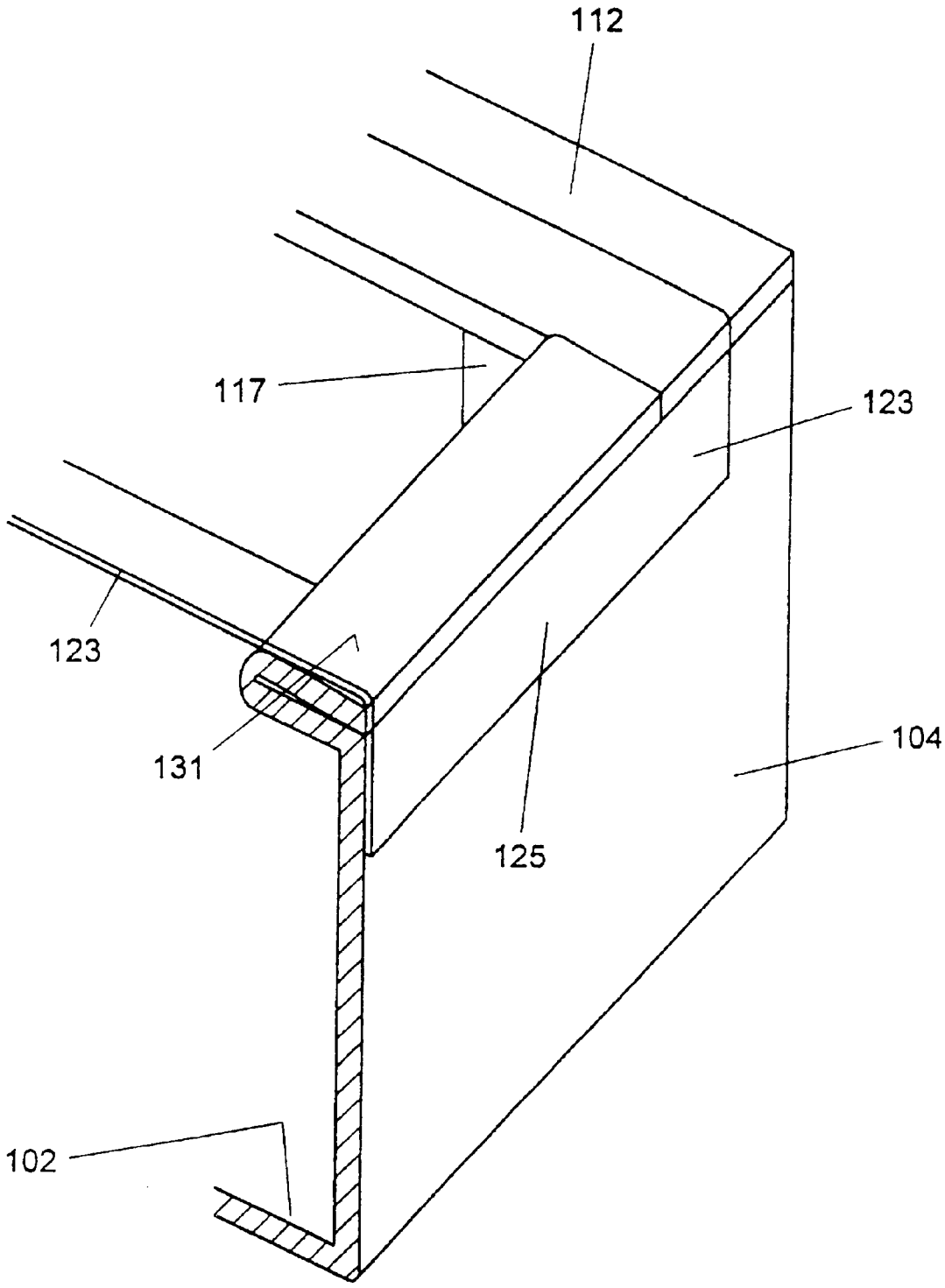
Figure 5:
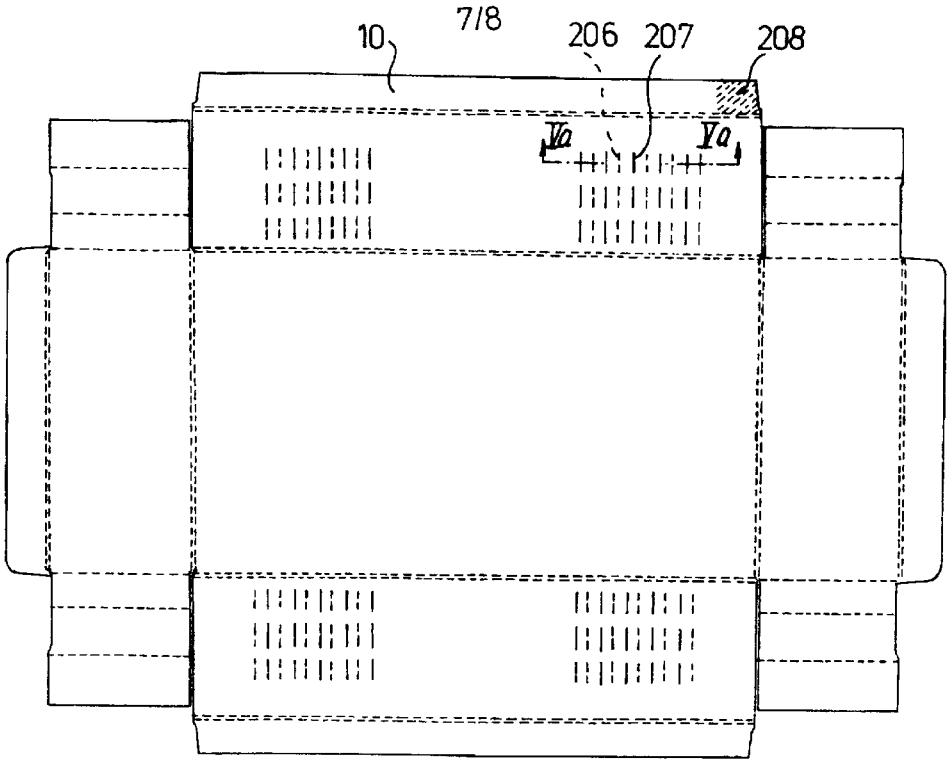
Figure 6:
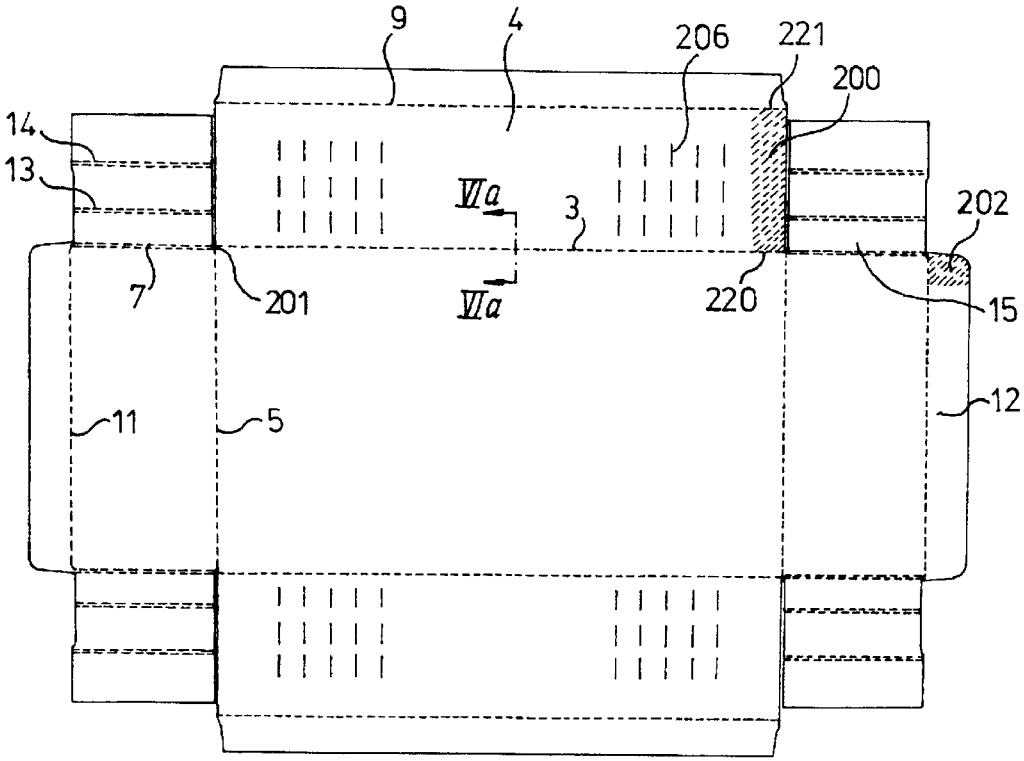
Figure 5A:
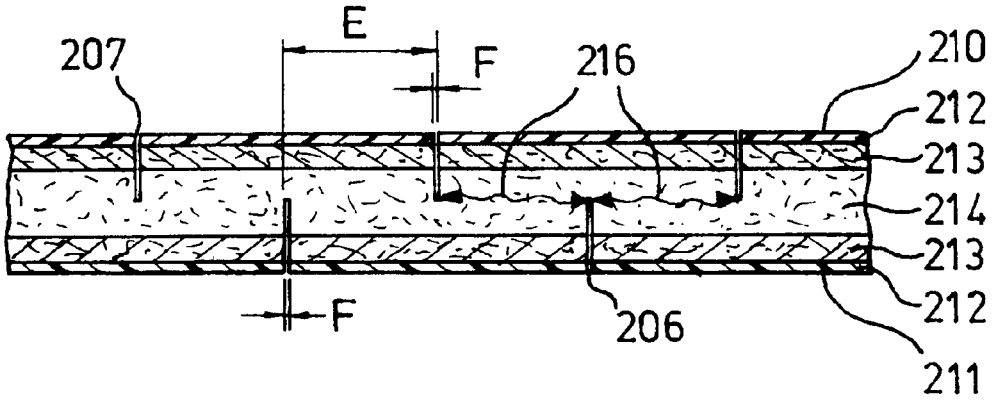

To illustrate the invention, illustrative embodiments of a method and box according to the invention will be described, with reference to the drawing. In the drawing:

FIG. 1 shows a corner section of a blank for a box in a first embodiment;

FIG. 2*a* shows the blank section according to FIG. 1, partially made up;

FIG. 2*b* shows the blank section according to FIG. 1, fully made up;

FIG. 3 shows a corner section of a blank for a box in a second embodiment;

FIG. 4*a* shows a corner, partially made up, of a box, folded from a blank according to FIG. 3;

FIG. 4*b* shows a corner section of a box further made up from a blank according to FIG. 3;

FIG. 4*c* shows the corner section of a box according to FIGS. 4*a* and 4*b*. fully made up;

FIG. 5 shows a view of the underside or outside of a further embodiment of a blank for a box;

FIG. 5*a* shows a cross-section of a detail that has been indicated by arrows Va—Va in FIG. 5;

FIG. 6 shows a view of the top or inside of the blank from FIG. 5; and

Figure 6A:
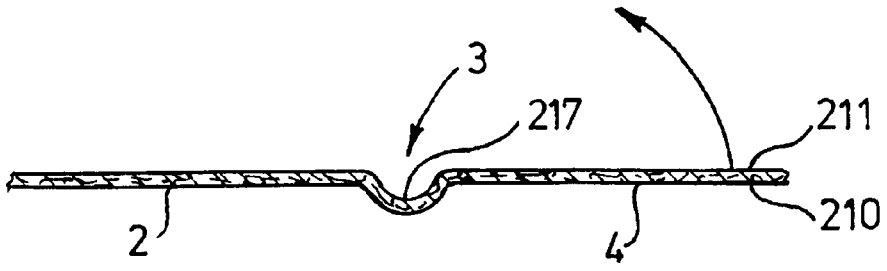

FIG. 6*a* shows a cross-section of a detail which has been indicated by arrows VIa—VIa in FIG. 6.

In the description corresponding parts have corresponding reference numerals. The blank 1 as shown in FIG. 1 comprises a rectangular base panel 2 that is joined to a first side wall panel 6, via a panel fold line 5, and to a second side wall panel 4 via a second panel fold line 3 extending at right angles to the first panel fold line 5. The part of the blank 1 shown in FIG. 1 is a corner section of a blank that is symmetrical about the dash-and-dot lines A, B. The first side wall panel 6 is joined via a joining flap fold line 7 to a corner flap 8, which will be described in more detail. The joining flap fold line 7 extends in the extension of the second panel fold line 3 offset by approximately the board thickness such that the length of the base 2 is somewhat shorter than the side wall panel 6, as a result of which folding of the box is simplified. The side wall panel 4 is joined to a second top flap 10 via a second top flap fold line 9, which extends parallel to the second panel fold line 3, whilst the side wall panel 6 is joined to a first top flap 12 via a first top flap fold line 11, which extends parallel to the first panel fold line 5. The distance between the second panel fold line 3 and the second top flap fold line 9 is equal to the distance between the first panel fold line 5 and the first top flap fold line 11 plus the thickness of the board for simple make-up of the box. The corner flap 8 is divided by a sixth fold line 13 and a seventh fold line 14, which both extend parallel to the joining flap fold line 7, into a joining flap 15 or first flap section 15, a somewhat broader second flap section 16 and an even broader third flap section 17.

The blank 1 is preferably made of board, in particular solid board, preferably of the sandwich type. In this context sandwich type must be understood as comprising board provided with at least one gas- and liquid-tight layer, preferably a plastic layer or protein layer. Such a layer, for example made of polyethene, is preferably applied at least to that side of the blank which faces inwards during use and can furthermore have been applied to the outside, whilst several intermediate layers can also have been provided. Applying a polyethene layer to the inward-facing side offers the advantage that a smooth box inside is obtained, which is aesthetically and hygienically advantageous.

The surfaces or surface sections to which adhesive is applied have been indicated on the blank 1 as shown in FIG. 1 with the aid of cross-hatching. Beads of filler adhesive, which form a mastic-like filler, have been indicated with the aid of close-set hatching FA and the surfaces and surface sections which are suitably provided with a layer of adhesive for gluing the flaps and panels concerned such that they are gas- and liquid-tight have been indicated by the wider spaced hatching A. This will be explained in more detail. The adhesive surfaces and adhesive surface sections have been shown in a corresponding manner in FIG. 3. In this figure hatching in broken lines indicates that the back of the panel or panel section shown has been provided with an adhesive layer or adhesive bead. It will, of course, be clear that it is also possible to provide corresponding surfaces or surface sections with the adhesive layer or adhesive bead when the box has been made up, whilst, moreover, adhesive can be applied to both surfaces to be brought into contact with one another. These variations will be immediately apparent to a person skilled in the art.

A box having an essentially rectangular cross-section and upright walls can be folded from the blank 1. Two of the steps in making up such a box are shown in FIGS. 2*a* and 2*b*.

When making up the box the corner flap 8 is folded over along the joining flap fold line 7 at right angles with respect to the side wall panel 6. The second flap section 16 is then folded over in the same direction along the sixth fold line 13 through an angle of, for example, approximately 45°. During this operation the third flap section 17 is folded back along the seventh fold line 14, such that said flap section comes to lie parallel to and in contact with the side wall panel 6 and is glued to the latter. By this means a triangular tubular section 18 is obtained which has a relatively high rigidity in at least the longitudinal direction. The side wall panel 6 is then folded over with respect to the base panel 2 along the first panel fold line 5 through an angle of 90°, such that the underside of the tubular section 18 comes into contact with the base panel 2. During this operation a filler adhesive 20 is applied, for example in bead form, in the second panel fold line 3 between the bottom longitudinal edge 19 of the joining flap 15, which bottom longitudinal edge faces towards the base panel 2 and which joining flap 15 is in contact with the said second panel fold line 3. A gas- and liquid-tight seal of said seam is obtained by this means. The side wall panel 4 is then folded up through 90° along the second panel fold line 3, such that the inside of the side wall panel 4 comes into contact with the joining flap 15. The side wall panel 4 is glued to the joining flap 15, such that a gas- and liquid-tight join is obtained. Furthermore, a bead of filler adhesive 21 is applied along the longitudinal edge 22 of the joining flap, which longitudinal edge 22 is in contact with the second top flap fold line 9, such that a gas- and liquid-tight seal for this seam is obtained. The second top flap 10 is then folded against the top of the tubular section 18 and glued thereon. Finally, the first top flap 12 is folded along the top flap fold line 11 and glued on the top of the second top flap 10, as shown in FIG. 2*b*. In this way a corner of a box is obtained which has been strengthened by a tubular section and which, moreover, has been made gas- and liquid-tight in a simple manner.

In the fully made-up state shown in FIG. 2, the box can be filled with living products, such as vegetables or fruit, for example broccoli, peppers, tomatoes, cucumbers and the like. A cover 23 in film form is then fitted over the open side of the box, i.e. the access opening, two opposing edge sections 24 of the film 23 being fixed on the top of the two first top flaps 12, whilst the two end edges 25 of the film 23 are pulled over the second top flap fold lines 9 and glued to the outside of the side wall panels 4. The open top of the box is likewise sealed gas- and liquid-tight by this means.

FIG. 3 shows an alternative embodiment of a corner section of a symmetrical blank 101, made from corrugated board, provided on either side with a gas- and liquid-tight, preferably polyethene, layer. Polyethene has the advantage that it can be recycled with the board. The blank 101 comprises a rectangular base section 102, a second side wall panel 104, that is joined to the base panel via a second panel fold line 103, and a first side wall panel 106, that is joined via a first panel fold line 105 to the base panel 102. For reasons that have been described above, the height of the side wall panels 104 is the thickness of the board less than the height of the side wall panels 106. Once again, a corner flap 108 is joined to the side wall panel 106 via a joining flap fold line 107 that, for reasons mentioned above, extends in the extension of the second panel fold line 103, offset by the thickness of the board. Once again, a second top flap 1 10 is joined to the side wall panel 104 via a second top flap fold line 109 and a first top flap 112 is joined to the side wall panel 106 via a first top flap fold line 111. Once again the corner flap 108 is divided into a first flap section 115 or joining flap 15, a second flap section 116 and a third flap section 117, which flap sections are separated from one another by, respectively, a sixth fold line 113 and a seventh fold line 114. A second fold-over flap 131, which has a somewhat shorter length than the second top flap 110, is attached to that side of the second top flap 110 which faces away from the side wall panel 104 via a double eighth fold line 130. which extends parallel to the top flap fold line 109 and second panel fold line 103. In a comparable manner a first fold-over flap 133 is joined to the first top flap 112 via a double ninth fold line 132. The ninth fold line 132 extends parallel to the first top flap fold line 111 and first panel fold line 105. The length of the first fold-over flap 133 is somewhat less than the length of the first top flap 112. The double fold lines 130, 132 have been chosen such that folding of the board is not prevented by the thickness of the (corrugated) board. Once again a rectangular, block-shaped box can be folded from the blank 101, three steps of which folding operation are shown in FIGS. 4*a* to 4*c*.

The partially made-up state shown in FIG. 4*a* essentially corresponds to that as shown in FIG. 2*a* for the box in the first embodiment. Once again an essentially triangular support column 118 has been formed from the corner flap 108, a bead of filler adhesive 120, which forms a gas- and liquid-tight seal, having been applied along the bottom edge of the joining flap 115 in the second panel fold line 103. A similar adhesive bead 121 has been applied along the opposite longitudinal edge of the joining flap 115.

FIG. 4*b* shows a second stage in making up the box from the blank 101, the second top flap 110 having been folded through 90° along the second top flap fold line 109 as far as the top of the tubular section 118 and glued thereon. The second fold-over flap 131 has then been folded through 180° along the double fold line 130 and glued to the top and outside of the second top flap 110. By this means an edge of the two flaps 110, 131 which is gas- and liquid-tight towards the inside of the box has been obtained. The first fold-over flap 133 has then been folded inwards through 180° along the double ninth fold line 132 and glued to the inside/underside of the first top flap 112 (shown in broken lines in FIG. 4*b*). As can clearly be seen from FIG. 4*c*, the first top flap 112 with the first fold-over flap 133 glued thereon has then been folded inwards through 90° along the first top flap fold line 111, the first top flap 112 having been glued to the exposed part 110*a* of the second top flap 110, then to the free longitudinal edge of the second fold-over flap 131. In this way the entire longitudinal edge has a closed inward-facing edge, whilst the top surface of the box, formed by the outside of the first top flap 112 and the second fold-over flap 131, is completely flat. After the box has been filled with living products, a film has been fixed over the said flaps 112 and 131 and, if appropriate, pulled through as far as the outside of the side wall panel 104 and fixed thereto.

In the embodiments shown the film 23, 123 is transparent, such that the contents of the box can be inspected without the seal having to be broken.

A box according to the present invention suitable for packing living products under conditioned atmospheric conditions has a rectangular outer periphery, defined by the first and second side wall panels. Consequently the boxes can be tightly stacked, as a result of which optimum use can be made of transport and storage space. In this context the support columns 18, 118 have the advantage that the boxes can be stacked simply on top of one another and have and retain adequate bearing capacity, even when in use for a prolonged period. Even if the board is somewhat damp, the support columns will retain adequate bearing capacity to prevent damage to the stored living products.

When board of the sandwich type is used, the plastic layer is preferably applied to one or both sides. According to the third aspect of the invention, the plastic layer can be damaged somewhat at various locations, for example by punching and folding operations and by board fibers, thus providing micro-openings which enable transport of moisture and/or gas, in particular $O_2$ and/or $CO_2$, through the plastic layer to a very slight extent. The micro-openings preferably have a total surface area of 0.1% of the total outer surface area of the box, more particularly a total surface area of less than 0.05% and more than 0.01%. The damage extending through the plastic layer preferably has a maximum width or cross-section of less than 20 micrometers, on average preferably between 10 and 20 micrometers. Consequently, moisture will not be able to pass through the plastic layer unimpeded. The plastic layer can optionally have a low gas permeability, depending on the products to be packed. The gas permeability is preferably less than 20,000 ml/m$^2$/24 hours/25° C. More particularly, the gas permeability is less than approximately 1,000 ml/m$^2$/24 hours/25° C., preferably less than 800 ml/m$^2$/24 hours/25° C. Moreover, a less than 100% tight application of adhesive can ensure some (gas) leakage. The amounts of (gas) leakage are preferably between 10 and 40 ml/min/bar for the types of box described. Preferably, no additional gas is supplied when filling the box with living products. As a consequence of the residual metabolism of the products to be packed, a somewhat raised $CO_2$ concentration and raised atmospheric humidity will be produced in the box, suitable for good preservation of the said living products. This is in particular also dependent on the residual activity of the products. In this context, for example, bean sprouts and broccoli can be regarded as particularly active, apples as moderately active and carrots as being of low activity. Moreover, higher leakage will have to be provided for larger quantities of packed products. The relatively high atmospheric humidity offers the advantage that there is virtually no loss of moisture from the products, as result of which the products retain their initial weight. This avoids the need to pack excess eight when packing in order to obtain the desired delivery weight. Consequently, better use an be made of available packing volume, transport volume and the like, which is particularly advantageous in terms of economics. Surprisingly, it has been found that living products packed in a box according to the invention can be stored for a particularly long period without loss of quality, under highly fluctuating and actually adverse conditions, such as at relatively high outside temperatures.

FIGS. 5 and 6 show, diagrammatically, a top and a bottom view respectively of a blank such as is in essence also shown, in quarter form, in FIG. 1. Therefore, reference can be made to the description with reference to FIGS. 1, 2*a* and 2*b* for making up the box and producing the corner joins during this operation.

In the bottom view according to FIG. 5 the view is of that part of the blank which when the box has been made up will essentially form the outside thereof. In the top view according to FIG. 6 the view is of that part of the blank which when the box has been made up will essentially form the inside thereof.

FIGS. 5 and 6 also specifically indicate the overlap area 200 on the inside of the second side wall panel 4 against which the outside of the joining flap 15 comes into contact when the box has been made up and the corner join has been produced. Furthermore, the region of the second panel fold line 3 at the location of the overlap area 200 is indicated by 220 in FIG. 6. The region of the second top flap fold line 9 at the level of the overlap area 200 is indicated by 221.

202 and 208 indicate the opposing flat sections of the first top flap 12 and second top flap 10 which together form the overlap zone between them.

Furthermore, 201 indicates the bottom corner point, or at least the region where said bottom corner point is located, of the corner join to be formed. The corner itself is essentially defined by the joining flap fold line 7, the bottom end of which terminates in the bottom corner point 201 and the top end of which terminates in the top corner point.

Air passages, which in particular form part of the second main aspect according to the invention, are also shown in FIGS. 5 and 6, as also in FIG. 1.

The air passages consist of matrix patterns of scores 206 made in the inside and matrix patterns of scores 207 made on the outside of the blank. The so-called second side wall panels 4 are each provided both on the inside and on the outside with, in each case, two such matrix-like patterns. With this arrangement said matrix-like patterns are always located outside the so-called overlap areas 200.

The scores 206 and 207 can be described in more detail with reference to FIG. 5*a* and FIG. 1.

FIG. 5*a* shows a detail of a cross-section through the blank. As can be seen in FIG. 5*a,* the blank is coated on the outside with, in each case, a PE coating 212 applied on top of a socalled kraft liner 213, with a so-called grey board 214, which is watertight, between the kraft liners 213. As is indicated by arrows 216, the grey board 214 is capable of allowing the passage of gas via a sort of diffusion process, that is to say is permeable to gas. The scores 206 and 207 have in each case been made through the coating made of PE, or optionally a material based on protein or starch, through the kraft liner 213 as far as approximately the middle of the grey board 214. The scores 206 and 207 have a certain width F, such that the transport of gas via the scores into the board is possible. The scores 207 in the outside 210 of the blank have been laterally offset with respect to the scores 206 in the inside 211 of the blank over a distance E. This distance is, for example, 15 mm. The distance K (FIG. 1) between scores located on one line on one side is, for example, 12 mm. The length H of each score is, for example, 25 mm. The lateral spacing between scores 206 is twice the distance E, as is also the lateral spacing between scores 207. If the width F of each score is kept constant, the permeability characteristics of the blank will then be a function of, inter alia, the sum of the length H of all scores together, the lateral offset E between opposing scores and the material characteristics of, in this case, in particular the grey board 214. Of course, the permeability characteristics will also be dependent on the width F of the scores, but from the standpoint of design it is more practical to keep this constant. Depending on the products to be packed in the box, it is thus possible to determine a design for the scores, in particular the total amount of existing length of scores as well as the lateral offset E.

In order to improve the folding characteristics of the blank, in particular with regard to the method of sealing the corner joins in accordance with the first main aspect of the invention, it is advantageous according to the invention if the fold lines have been made as crease lines, with a depression in the form of a groove 217 on one side and, correspondingly, a raised protrusion on the opposite side, as has been shown in FIG. 6*a* for the fold line 3. Making the fold lines 3, 5, 9 and 11 in such a way that the depression, that is to say the groove 217, is located on the inside 211 ensures that when the side wall panel 4 is folded through 90°, as has been indicated by the arrow in FIG. 6*a,* with respect to the base panel 2 an inward-jutting thickening is not produced on the inside of the box at the transition from the base panel 2 to the side wall panel 4. Such a thickening could impede flat contact of the joining flap 15 against the side wall panel 4 in the areas 220 and 221 and thus could make it more difficult to produce the seal between the joining flap and the side wall panel 4.

In FIGS. 5 and 6 the side where the fold line protrudes with a thickening is always shown by a double broken line and the side where the fold line forms a recess is always shown by a single broken line.

The invention is in no way restricted to the illustrative embodiments shown and described in the description and the drawing. Many variations thereon are possible.

For instance, a box according to the invention can have been provided with support columns in another way, with the box and the support columns having been folded from a single blank or from more than one blank. Moreover, for example, broader or narrower longitudinal edges can have been provided, if desired, whilst, moreover, the box can be sealed in another way. The sequence for making up the boxes which is given in the description can, of course, be changed, depending on, for example, the available tools, machinery and the like. Furthermore, if necessary, one or more layers of plastic without the said micro-openings can have been provided, the gas permeability of the board being wholly dependent on that of the said plastic layer or plastic layers. The air passages can also have been produced in diverse ways.

These and many comparable illustrative embodiments are considered to fall within the scope of the invention.

What is claimed is:

1. A method for forming a corner join at a corner of a box, wherein the box is formed from a blank comprising a base panel (2), a first side wall panel (6) joined to said base panel via a first panel fold line (5), a second side wall panel (4) joined to said base panel via a second panel fold line (3) and a joining flap (15) joined to the first side wall panel (6) via a joining flap fold line (7);

wherein the joining flap fold line (7) essentially determines the corner when the corner join has been formed;

wherein the first panel fold line (5) and the second panel fold line (3) and the joining flap fold line (7) essentially intersect one another at the bottom (201) of the corner at the base panel (2) and the first (6) and second (4) side wall panel extend as far as the corner when the corner join has been formed, said method comprising the steps of:

joining the first side wall panel (6) to the second side wall panel (4) by placing the joining flap (15) such that it overlaps the second side wall panel (4) in an overlap area (200) on the second side wall panel (4) and fixing it thereto, and applying a mastic-like filler (204; FA) in the form of a bead, in or on the inside of the second panel fold line (3), at the overlap area (200), characterised in that the mastic-like filler (204; FA) is applied to the blank (1) before the joining flap (15) is placed against the second side wall panel (4) and fixed thereto.

2. The method according to claim 1, wherein the blank is formed of board or paper.

3. The method according to claim 1, characterised in that the filler (204; FA) is at least applied in or on that end of the second panel fold line (3) which faces towards the corner (201; 7).

4. The method according to claim 1, characterised in that the mastic-like filler (204; AF) is applied to the blank before the first side wall panel (6) is raised with respect to the base panel (2) by folding about the first panel fold line (7).

5. The method according to claim 1, characterised in that the bead extends uninterrupted, along essentially the entire overlap area (200).

6. The method according to claim 1, characterised in that the outside of the joining flap (15) is provided with at least one adhesive strip which extends uninterrupted from the bottom edge (19) of the joining flap (15), which faces towards the base panel (2), to the top edge (203) of the joining flap (15), which faces away from the base panel, and the adhesive strip is applied such that, when the corner join has been formed, it abuts the filler (FA) at the bottom edge (19) of the joining flap (15).

7. The method according to claim 1, characterised in that the inside of the second side wall panel (4) is provided with at least one adhesive strip (A) which extends uninterrupted from the filler (204; FA) to at least the top end of the overlap area (200), and abuts the filler (FA; 204).

8. The method according to claim 1, wherein the second side wall panel (4) is provided with a second top flap (10) which is formed in one piece therewith and which is joined to the second side wall panel (4) via a second top flap fold line (9), which runs parallel to the second panel fold line (3), and is folded so as to point towards the inside of a box, characterised in that a mastic-like filler (205; FA) is applied in the form of a bead, in or on the inside of the second top flap fold line (9), at the location of the overlap area (200).

9. The method according to claim 8, characterised in that the application of the mastic-like filler in or on the inside of the second top flap fold line (9) takes place prior to folding the second top flap (10) towards the inside of the box.

10. The method according to claim 8, characterised in that the mastic-like filler (205; FA) is applied in or on the second top flap fold line (10) so that, when the corner join is formed, it abuts the top end of the adhesive strip or in that the mastic-like filler (205; FA) in or on the second top flap fold line (9) abuts the top end of the adhesive strip (A; 200).

11. The method according to claim 8, wherein the first side wall panel (6) is provided with a first top flap (12) which is formed in one piece therewith and which is joined via a first top flap fold line (11), which runs parallel to the first panel fold line (5), to the first side wall panel (6) and is folded so as to point towards the inside of the box so as partially to overlap the second top flap (10) at the corner (7) in an overlap zone (202), characterised in that a mastic-like filler is applied in bead form, in or on the inside of the first top flap fold line (11) at the location of the overlap zone (202).

12. The method according to claim 8, wherein the first side wall panel (6) is provided with a first top flap (12) which is formed in one piece therewith and which is joined via a first top flap fold line (11), which runs parallel to the first panel fold line (5), to the first side wall panel (6) and the box is folded inwards so as partially to overlap the second top flap (10) at the corner (7) in an overlap zone (202), characterised in that the overlap zone (202) is provided with at least one adhesive strip (A), either applied to the inside of the first top flap (12) or applied to the outside of the second top flap (10), said adhesive strip extending uninterrupted over the entire overlap zone (202) in a direction essentially parallel to that of the second top flap fold line (9).

13. The method according to claim 1, characterised in that the joining flap (15) is the first flap section of a corner flap (8) comprising at least three flap sections (15, 16, 17) joined to one another via fold lines running parallel to the joining flap fold line (7) and in that the flap section (17) located furthest away from the joining flap is fixed to the inside of the first side wall panel (6) to form a tubular section from the corner flap.

14. The method according to claim 1, wherein the mastic-like filler is an adhesive.

15. The method according to claim 1, wherein the second side wall panel (4) is provided with a second top flap (10) which is formed in one piece therewith and which is joined to the second side wall panel (4) via a second top flap fold line (9), which runs parallel to the second panel fold line (3), and is folded so as to point towards the inside of a box, and wherein the first side wall panel (6) is provided with a first top flap (12) which is formed in one piece therewith and which is joined via first top flap fold line (11), which runs parallel to the first panel fold line (5), to the first side wall panel (6) and is folded so as to point towards the inside of the box, characterised in that at least one of the first panel fold line (5), the second panel fold line (3), the first top flap fold line (11), and the second top flap fold line (9) are crease lines, the groove of which is located on the inside of the fold line concerned.

16. The method according to claim 1, characterised in that the joining flap fold line (7) is a crease line, the groove of which is on the outside of the joining flap fold line.

17. The method according to claim 1, characterised in that adhesive (A) is spread over the entire overlap area (200) and/or the overlap zone (202).

18. The method according to claim 1, characterised in that the joining flap (15) is constructed such that when the corner join has been formed the bottom edge (19) thereof is essentially in contact with the base panel (2).

19. The method according to claim 1, wherein the blank is formed from a solid board, with a core of grey board, and is coated on one or both sides with a coating of plastic or of protein, which is impermeable to gas and/or liquid, characterised in that the coating is provided with air passages (206; 207) which extend into and open into a part of the core located behind the respective air passages.

20. The method according to claim 19, characterised in that the air passages (206; 207) are formed in one or more side wall panels (4, 6), outside the overlap areas (200).

21. The method according to claim 19, characterised in that the air passages (206; 207) are scores extending into the core.

22. The method according to claim 20, characterised in that, when viewed parallel to the blank surface, the scores (206; 207) have a length (E) of approximately 10 mm to approximately 50 mm.

23. The method according to claim 21, characterised in that the scores (206; 207) extend transversely to the respective panel fold line (3; 5).

24. The method according to claim 19, wherein the blank is coated with the coating on both sides, characterised in that the air passages (206) on one side of the blank are offset (E) with respect to the air passages (207) on the other side of the blank.

25. The method according to claim 24, wherein the air passages extend as far as approximately the middle of the core.

26. The method according to claim 25, characterised in that the offset (E) is at least 5 to 10 mm.

27. The method according to claim 25, characterised in that the offset (E) is approximately 30 to 40 mm.

28. The method according to claim 19, characterised in that the air passages (206; 207) for said coating correspond with one or more groups of matrix patterns.

29. The method according to claim 19, wherein the box has an access opening, wherein the blank includes blank sections joined via fold lines into one piece, wherein the fold lines of the blank sections are essentially gas-tight and wherein the surface spanned by the blank is essentially closed.

30. The method according to claim 1, wherein an adhesive pattern of adhesive (A) is applied to each joining flap (15) and/or to each overlap area (200); and/or a mastic-like filler (FA; 204) is applied in the region of each overlap area (200) in or on each adjacent second panel fold line (3) so that, in a box folded from the blank, wherein each joining flap (15) is glued to an adjoining longitudinal wall panel (4), at least the corner point (201) located at the point of intersection of the first panel fold line (5), the second panel fold line (3) and the joining flap fold line (7) is closed off towards the interior of the box by the adhesive (A; 200) in the adhesive pattern and/or the mastic-like filler (FA; 204).

31. The method according to claim 30, wherein the application of the adhesive pattern (A; 200) and/or the filler (FA; 204) is such that each seam extending from said point of intersection is closed off by the adhesive or, respectively, the filler.

32. The method according to claim 30, wherein the blank is formed from solid board having a sandwich formation.

33. The method according to claim 30, wherein the blank is formed from corrugated board.

34. The method according to claim 30, wherein the blank is provided on at least one side with a plastic or protein coating.

35. The method according to claim 30, wherein the blank is provided on at least one side with a plastic coating, wherein the coating is provided with air passages.

36. A method for obtaining a box which can breathe in a controllable manner, comprising the steps of:

making the box from a blank which has been produced from solid cardboard with a core of grey board, wherein the box has a coating on one or both sides, which is impermeable to gas and/or liquid, characterised in that the coating has air passages (206; 207) which extend through the coating, into a part of the core located behind the respective air passages, and open into said part of the core located behind the respective air passages.

37. A box comprising:

a base panel (2);

a first side wall panel (6) joined to said base panel via a first panel fold line (5);

a second side wall panel (4) joined to said base panel via a second panel fold line (3); and a joining flap (15) joined to the first side wall panel via a joining flap fold line (7), wherein the joining flap (15) is the first flap section of a corner flap (8) which comprises at least three flap sections (15, 16, 17) joined to one another via fold lines running parallel to the joining flap fold line (7), and one of the flap sections (17), which is located furthest away from the joining flap, is fixed to the inside of the first side wall panel (6) to form a tubular section from the corner flap, and wherein a mastic-like filler (204; FA) in the form of a bead is applied in or on the inside of the second panel fold line (3) at the overlap area (200).

38. The box according to claim 37 wherein the box is used for packing and/or storing and/or transporting living products and/or vegetables and/or fruit and/or meat and/or fish.

39. A rectangular box comprising:

a rectangular base panel (2), having two transverse walls (6) or longitudinal walls (4), each forming a first side panel; and two longitudinal walls (4) or, respectively, transverse walls (6), each forming a second side panel, wherein, the first side panel is joined to the base panel via a first panel fold line (5), the second side wall panel is joined to the base panel via a second panel fold line (3), a joining flap is joined to the first side wall panel via a joining flap fold line (7), and the joining flap is the first flap section of a corner flap (8) which comprises at least three flap sections joined to one another via fold lines running parallel to the joining flap fold line, and one of the flap sections which is located furthest away from the joining flap is fixed to the inside of the first side wall panel to form a tubular section from the corner flap.

40. The rectangular box according to claim 39 wherein a filling is placed in the box, wherein the filling comprises at least one of a living produce, vegetables, fish and meat and wherein the access opening to the box is closed in an essentially gas-tight manner.

* * * * *